United States Patent [19]

Lund

[11] 4,178,906

[45] Dec. 18, 1979

[54] KITCHEN COUNTERTOP WOOD OR COAL STOVE

[76] Inventor: Lloyd W. Lund, R.F.D. #2, Chapel Rd., Waldoboro, Me. 04572

[21] Appl. No.: 849,949

[22] Filed: Nov. 9, 1977

Related U.S. Application Data

[63] Continuation of Ser. No. 676,113, Apr. 12, 1976, abandoned.

[51] Int. Cl.[2] ..... F24C 1/14

[52] U.S. Cl. ..... 126/6; 126/211

[58] Field of Search ..... 126/1 F, 1 AD, 1 AE, 126/4, 6, 211, 217

[56] References Cited

U.S. PATENT DOCUMENTS

| | | | |
|---|---|---|---|
| 799,084 | 9/1905 | Pederson | 126/4 |
| 935,313 | 9/1909 | Lauer et al. | 126/211 |
| 2,180,788 | 11/1939 | Berkheimer | 126/4 |
| 2,196,467 | 4/1940 | Masonick | 126/4 X |
| 2,480,610 | 8/1949 | Reynolds | 126/4 |

FOREIGN PATENT DOCUMENTS

| | | | |
|---|---|---|---|
| 326061 | 2/1932 | Canada | 126/163 |

*Primary Examiner*—Edward G. Favors
*Attorney, Agent, or Firm*—Ernest F. Marmorek

[57] ABSTRACT

A stove shaped to fit flush with the top and sides of a standard kitchen counter, with the stove designed to burn solid fuel such as wood, coal or trash. The stove is formed of insulated rectangular side walls and an insulated rectangular rear wall, with an insulated rectangular floor mounted at the bottom of the stove sides. The interior is divided into an upper combustion space and a lower ash collection compartment, with a slidable drawer mounted in the lower ash collection compartment to enable ready removal of the burnt ashes. A front door enclosed the ash collection compartment, and a removable top plate provides access to the combustion space.

10 Claims, 4 Drawing Figures

KITCHEN COUNTERTOP WOOD OR COAL STOVE

This is a continuation, of application Ser. No. 676,113, filed Apr. 12, 1976, abandoned.

SUMMARY OF THE INVENTION

My invention is a stove shaped to fit flush with the top and sides of a standard kitchen counter, with the stove designed to burn solid fuel such as wood, coal or trash. The stove is formed of insulated rectangular side walls and an insulated rectangular rear wall, with an insulated rectangular floor mounted at the bottom of the stove sides. The interior is divided into an upper combustion space and a lower ash collection compartment, with a slidable drawer mounted in the lower ash collection compartment to enable ready removal of the burnt ashes. A front door encloses the ash collection compartment, and a removable top plate provides access to the combustion space.

By means of my invention, housewives will be able to employ a solid fuel stove in a kitchen fitted with a standard countertop and other standard countertop accessories, so as to conserve the use of scarce petrochemicals such as gas and oil. The stove of my invention will utilize firewood, coal, or household trash to furnish cooking heat at low cost.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
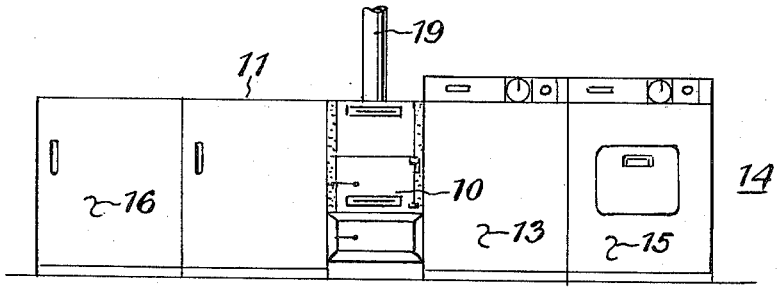
FIG. 1 is an elevation view of the invention in use.

Turning now descriptively to the drawings, in which similar reference characters denote similar elements throughout the several views, FIG. 1 illustrates the Kitchen Counter Wood or Coal Stove 10 mounted flush with the top deck 11 and forward face 16 of a kitchen counter assembly 14 alongside kitchen accessories such as clothes washer 13 and a clothes dryer 15.

As shown in FIGS. 1–4 the stove 10 is formed of a pair of rectangular steel side panels 21 joined to a steel rear vertical panel 21R and a bottom panel 24. Fire bricks 28 line the interior of the side panels 21, and the rear vertical panel 21R. A front panel 27 is fitted with a hinged door 33 to provide access to the internal combustion chamber 30. Adjustable vent openings 29 are fitted in door 33 and in upper fixed section 27U of the front panel 27 to provide for draft regulation above and below the fire in the combustion chamber 30.

The combustion chamber 30 is enclosed along its bottom by a bottom panel 24 formed with through perforations 51 to permit ashes to drop into lower ash compartment 31 below combustion chamber 30.

The top plate 34 of the stove 10 is formed of steel and fitted with a flanged opening 17 for fastening to a flue pipe 19, and fitted with concentric circular removable sections 37, 38, 39 mounted in a rectangular removable section 44.

Solid fuel may be rested on bottom panel 24 by removing and replacing top section 44 or individual sections 37, 38 or 39.

The lower ash compartment 31 is formed of a pair of rectangular side panels 36S and a rear panel 36R and fitted with a solid base panel 32 to retain slidable ash drawer 26. Front compartment door 35 is pivotably mounted by vertical hinge 59 to front panel 20 to permit withdrawal of ash drawer 26, with a latch 58 externally mounted on door 35.

Figure 2:
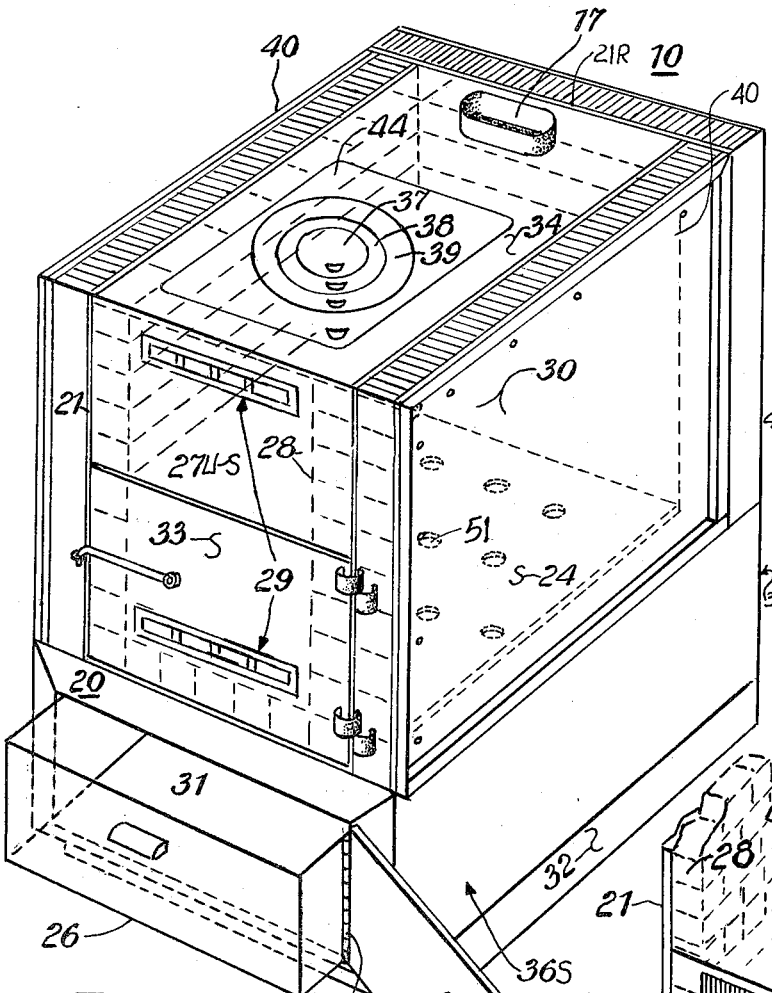
FIG. 2 is a perspective view of the invention.
Figure 4:
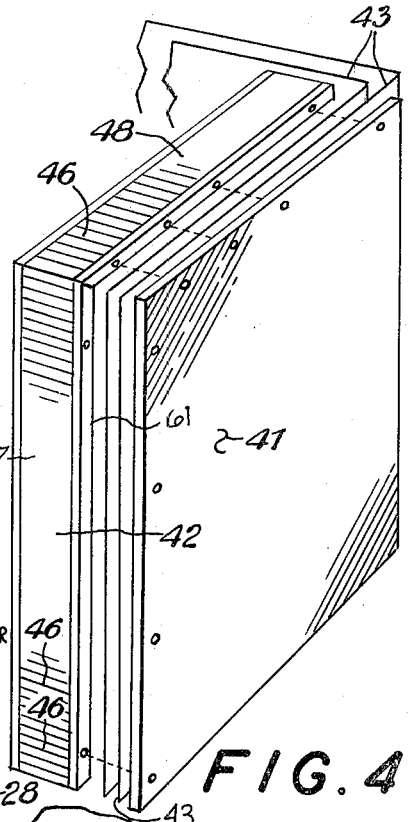
FIG. 4 is an exploded perspective view of a wall of the invention.
Figure 3:
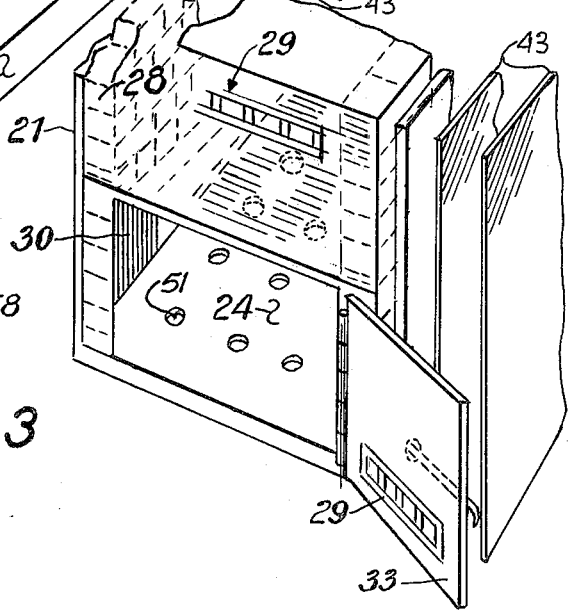
FIG. 3 is a fragmentary view of the interior of the invention.

As shown in FIGS. 2 and 4, the oven is fitted with vented side assemblies 40, each formed of a baffle 43 fastened to an external insulated external panel 41 with baffle 43 and panel 41 bolted to a continuous flange 61 along the edge of an angle member 42 that fastens along the top and front edges of each side panel 21. Through vents 46 are formed in the front face 47 and top face 48 of angle members 42 for circulation of air, with baffle 43 deflecting heat from external insulated panels 41.

The stove 10 is fitted with adjustable length legs mounted in base panel 32 to adjust the height so that the top plate 34 of oven 10 may be located flush with the counter top of a kitchen counter and with the top of adjoining appliances 11, 13, 15 and 16.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A solid fuel stove of a size to operatively fit alongside a kitchen counter unit, in which said stove is formed with a combustion chamber lined on its sides and rear by a lining and bounded externally by insulating side wall assemblies and an insulating rear wall assembly, wherein said side and rear wall assemblies are formed of an exterior imperforate panel spaced from said lining by baffles, with a continuous series of vents extending along the front face and top face of each side wall assembly opening to the interior of said side wall assemblies.

2. A solid fuel stove according to claim 1, wherein said lining comprises fire bricks.

3. A solid fuel stove according to claim 1 further comprising a front panel and a door hingeably connected to said front panel to provide access to said combustion chamber.

4. A solid fuel stove according to claim 3, wherein said front panel and said door has adjustable vent openings provided therein to operatively regulate draft in said combustion chamber.

5. A solid fuel stove according to claim 1, wherein said stove further comprises an ash compartment disposed below said combustion chamber and a perforated bottom panel disposed between said combustion chamber and said ash compartment for ashes to fall through said perforated bottom panel into said ash compartment.

6. A solid fuel stove according to claim 5, wherein said ash compartment further comprises a front plate, a second door hingeably connected to said front plate, said second door having open and closed positions, and latch means mounted on said second door for maintaining said second door in said closed position.

7. A solid fuel stove according to claim 5 wherein said ash compartment comprises side-wall and rear wall assemblies and a base plate, and further comprising an ash drawer slidable into and out of said ash compartment.

8. A solid fuel stove according to claim 1 further comprising a metal top plate having an opening for communicating with a flue pipe, a cover plate being detachably mounted to said top plate.

9. A solid fuel stove according to claim 8, further comprising a plurality of circular and substantially concentric sections fitted to, and detachably mounted on said cover plate.

10. A solid fuel stove according to claim 1, wherein said stove is operatively accessible only from the front and top of said combustion chamber.

* * * * *